United States Patent [19]

Ueda et al.

[11] Patent Number: 4,817,425

[45] Date of Patent: Apr. 4, 1989

[54] YARN DEFECT DETECTING METHOD

[75] Inventors: Yutaka Ueda, Nara; Toshio Yamauchi, Kyoto, both of Japan

[73] Assignee: Murata Kikai Kabushiki Kaisha, Kyoto, Japan

[21] Appl. No.: 40,299

[22] Filed: Apr. 20, 1987

[30] Foreign Application Priority Data

Apr. 25, 1986 [JP] Japan ..... 61-96144

[51] Int. Cl.[4] ..... D01H 13/22

[52] U.S. Cl. ..... 73/160; 57/264

[58] Field of Search ..... 73/160; 57/263, 264, 57/265; 242/36

[56] References Cited

U.S. PATENT DOCUMENTS 3,476,329 11/1969 Felix ..... 73/160 X 3,748,707 7/1973 Aihara et al. ..... 73/160 X 4,007,457 2/1977 Aeppli ..... 57/264

4,137,699 2/1979 Stahlecker et al. ..... 57/264

4,195,345 3/1980 Artzt et al. ..... 57/264 X 4,246,748 1/1981 Artzt et al. ..... 57/264 X

*Primary Examiner*—Joseph J. Hail, III

*Attorney, Agent, or Firm*—Spensley Horn Jubas & Lubitz

[57] ABSTRACT

A method of detecting a defect of a running yarn comprises steps of producing an electric signal in accordance with a winding speed of a yarn, correcting a reference value corresponding to a length of a defect of a yarn in accordance with the electric signal, and comparing the thus corrected reference value with a detection signal produced from a yarn defect detecting head thereby to detect a defect of the yarn included in the yarn during feeding.

9 Claims, 4 Drawing Sheets

YARN DEFECT DETECTING METHOD

FIELD OF THE INVENTION AND RELATED ART STATEMENT

This invention relates to a yarn defect detecting method for a yarn winding machine such as an automatic winder.

An automatic winder normally includes a device that is called a yarn clearer for detecting and removing a defect of a yarn which is drawn from a spinning bobbin and rewound in a string of a predetermined length in a predetermined shape.

Such yarn defects include a nep, a slub, a thicker portion, a thinner portion and so on, and a nep generally has a thickness of several ten times to an average thickness of a yarn and a length of several millimeters while a slub has a thickness of several times to an average yarn thickness and a length of several to several tens of centimeters.

Such a defect of a yarn will cause, when it passes a measuring head such as a photoelectric slub catcher or an electrostatic slub catcher during feeding of the yarn, the measuring head to produce an electric signal in accordance with a thickness of the yarn defect, and the level of the electric signal thus produced is compared with a preset level in order to find out the yarn defect.

The speed of a yarn passing through such a yarn clearer as described above varies between zero and an ordinary feeding speed when it is relatively low such as, for example, when a motor for driving a winding package is activated or deenergized. In such a case, the yarn clearer may detect a defect of a yarn in error, which will result in subsequent cutting and joining of the yarn in vain.

Accordingly, in order to eliminate such an inconvenience, where a motor for driving a drum is deenergized in response to a fully wound up signal, conventionally the fully wound up signal is used as a blocking signal for the yarn clearer so that the yarn clearer may not watch a yarn during rotation of the drum by its own inertia.

PROBLEM TO BE RESOLVED BY THE INVENTION

Accordingly, during variations of the speed of a yarn, such as during rotation of the drum by its own inertia or at an initial stage of starting of rotation of the drum, a defect of a yarn will not be detected and will consequently be involved in a winding package, resulting in deterioration of the quality of the package thus produced.

OBJECT AND SUMMARY OF THE INVENTION

It is an object of the present invention to propose a method of detecting a defect of a running yarn in which a detected value can be compared with a reference value which is corrected in accordance with the current yarn speed.

According to an embodiment of the present invention, a method of detecting a defect of a yarn comprises the steps of producing an electric signal in accordance with a winding speed of a yarn, correcting a reference value corresponding to a length of a defect of a yarn in accordance with the electric signal, and comparing the thus corrected reference value with a detection signal produced from a yarn defect detecting head to thereby detect a defect of the yarn included in the yarn during feeding.

DETAILED DESCRIPTION OF PREFERRED EMBODIMENTS

Now, an embodiment of the present invention will be described with reference to the drawings.

Figure 2:
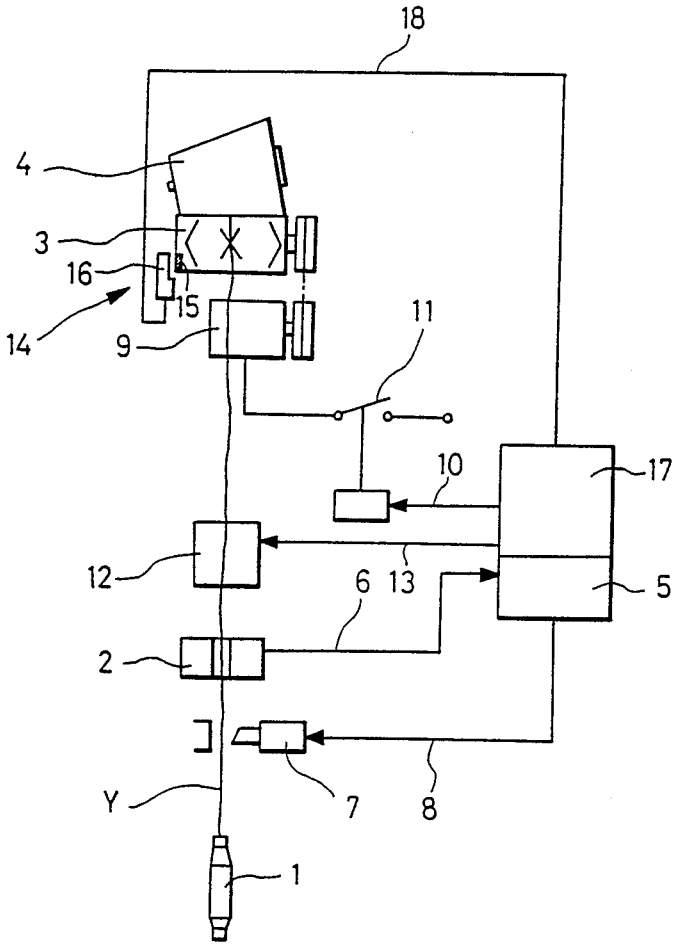
FIG. 2 is a diagrammatic representation showing construction of a winding unit.

FIG. 2 illustrates general construction of a winding unit of an automatic winder. In particular, a yarn Y drawn out from a spinning bobbin 1 is passed through a tension device and a waxing device not shown and then checked by a yarn defect detector 2 such as a slub catcher in order to detect a defect of the yarn Y, whereafter the yarn Y is wound onto a package 4 which is rotated by a traverse drum 3.

While the yarn Y is wound onto the package 4, the varying thickness of the yarn passing through the slub catcher 2 is normally delivered as an electric signal 6 to a clearer controller 5 and is compared by a predetermined method therein with a reference value which will be hereinafter described. If the yarn thickness is out of a range provided by the reference value, then the clearer controller 5 determines that a yarn defect has passed the slub catcher 2 and immediately delivers an operating signal 8 to a cutter driving device 7 so that a cutter may operate to cut the yarn Y. After the yarn Y is thus cut, the yarn feeding signal is not developed from the slub catcher 2. The absence of the yarn feeding signal represents that the yarn Y has been cut. As the cutting of the yarn is sensed in this manner, the controller 5 delivers a stopping instruction 10 to a drum driving motor 9 so that a contact 11 is opened to deenergize the motor 9 and consequently the traverse drum 3 is stopped shortly after some further rotation thereof by its own inertia.

Subsequently, a yarn splicing operation instructing signal 13 is delivered to a yarn splicing device 12 on which a yarn splicing operation is thus carried out by a known means. Thereupon, a portion of the yarn, located around the defect that was cut off by the cutter, is sucked and removed by means of a yarn end guiding suction mouth not shown.

It is to be noted that reference numeral 14 in FIG. 2 denotes a pulse generating device for detecting rotation of the traverse drum 3. The pulse generating device 14 includes, for example, a magnet 15 located on an end face of the traverse drum 3, and an adjacent sensor 16. The pulse generating device 14 is connected to deliver a pulse signal 18 generated therefrom to a fixed length measuring mechanism 17 for calculating a length of the yarn wound onto the package 4 from a rotational frequency of the drum 3. According to the present invention, the pulse signal 18 is also used for calculation of a speed of a yarn during winding.

Figure 3:
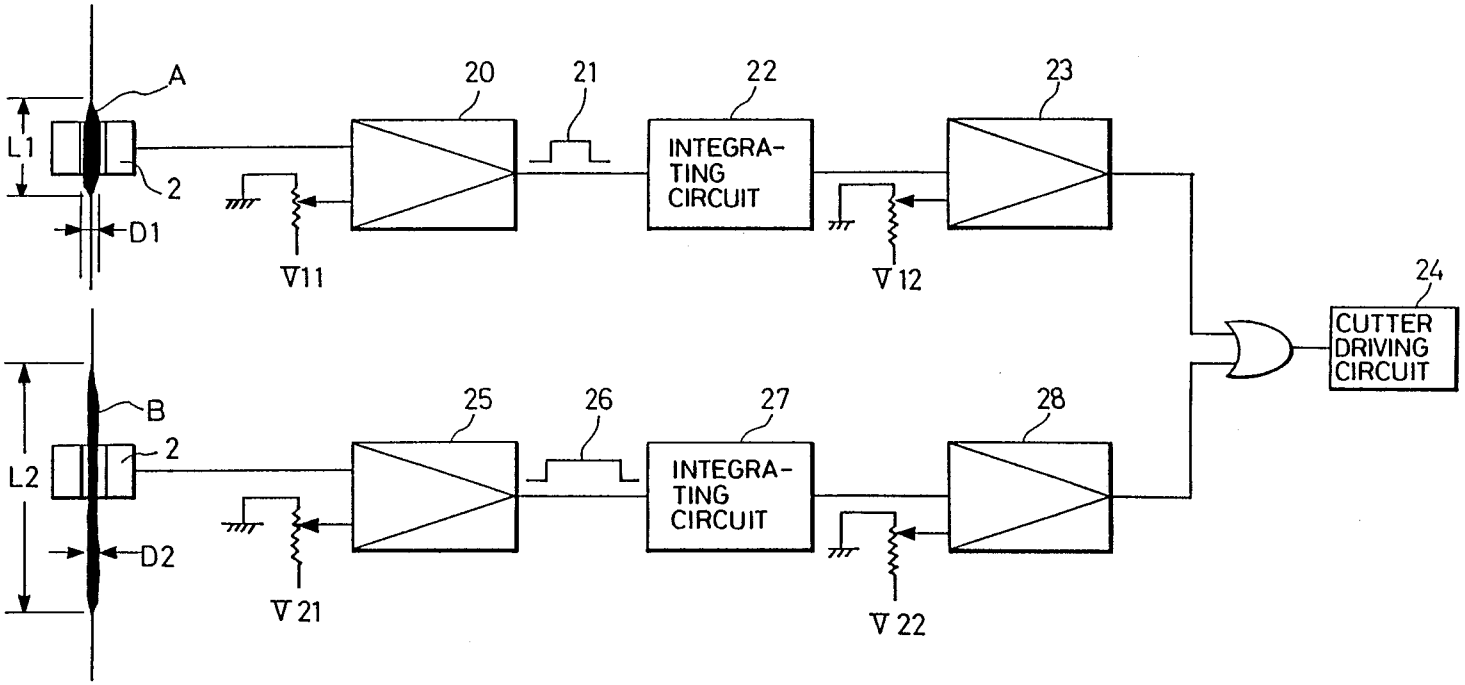
FIG. 3 is a view illustrating an example of a circuit for detecting a defect of a yarn and a type of the yarn defect.

The yarn clearer controller 5 has such a circuit construction, for example, as illustrated in FIG. 3.

It is to be noted that while a defect of a yarn may be any of such various types as described hereinabove, detection thereof is influenced principally by a feeding speed thereof and is dependent upon the type thereof. Such a yarn defect may be, for example, as illustrated in FIG. 3, a defect A of a type which has a large outer diameter D1 and a relatively great length L1 or another defect B of a type which has a smaller outer diameter D2 than the outer diameter D1 of the defect A but has a greater length L2 than the length L1 of the defect A.

If, for example, a defect A of a yarn passes the slub catcher 2, an electric signal (voltage) having a numerical value corresponding to the thickness D1 of the yarn defect A will be delivered to and compared on a comparator 20 with a reference voltage V11 corresponding to an allowable yarn thickness. Thus, if the voltage corresponding to the thickness D1 of the yarn defect A is greater than the reference value V11, a square wave signal 21 is developed from the comparator 20. An integrating circuit 22 receives the square wave signal 21 from the comparator 20 and delivers an electric signal (voltage) corresponding to the length L1 of the yarn defect A to another comparator 23 on which the electric signal (voltage) from the integrating circuit 22 is compared with another reference value V12. Accordingly, if the electric signal (voltage) is out of a range provided by the reference value V12, then this means that the presence of the yarn defect A is detected, and consequently a cutter driving circuit 24 is energized immediately to effect a yarn cutting operation.

Also in the case of the yarn defect B, an electric signal corresponding to the thickness D2 of the yarn defect B is delivered to and compared on the comparator 25 with the reference value V21, and if the electric signal is out of a range provided by the reference value V21, then a square wave signal 26 is developed from the comparator 25. Consequently, an electric signal which is produced by the integrating circuit 27 by integration of the square wave 26 for a period of time corresponding to the length L2 of the yarn defect B is delivered to the comparator 28 on which the electric signal is compared with another predetermined reference value V22. Thus, if the electric signal is out of the range provided by the reference value V22, then this means that presence of the yarn defect B is detected, and consequently the cutter driving circuit 24 is activated.

Since the time required for a particular length L1 of a yarn to pass the slub catcher 2 is constant when the speed of the yarn is constant, the reference value V12 is held constant. For example, where the yarn speed is 1,000 m/min, that is, 16.7 m/sec, the time required for a defect of a length L1=1 cm to pass the slub catcher 2 is about 0.6 ms, and the reference value V12 may be determined by integration of the square wave 21 corresponding to the specific time.

However, if the yarn speed varies, naturally the time required for the particular length of the yarn to pass the slub catcher 2 varies, and if the yarn speed rises to 2,000 m/min, the time required for a similar yarn defect A to pass the slub catcher 2 will be 0.3 ms. This value, however, is smaller than the reference value V12 which is determined for 0.6 ms, and consequently the yarn defect will not be detected.

In accordance with the present invention, the reference value V12, V22 for the lengths L1, L2 are changed tracing a change of the speed of a yarn so that the reference length of a yarn defect relative to a feeding speed of the yarn may be maintained constant.

Figure 1:
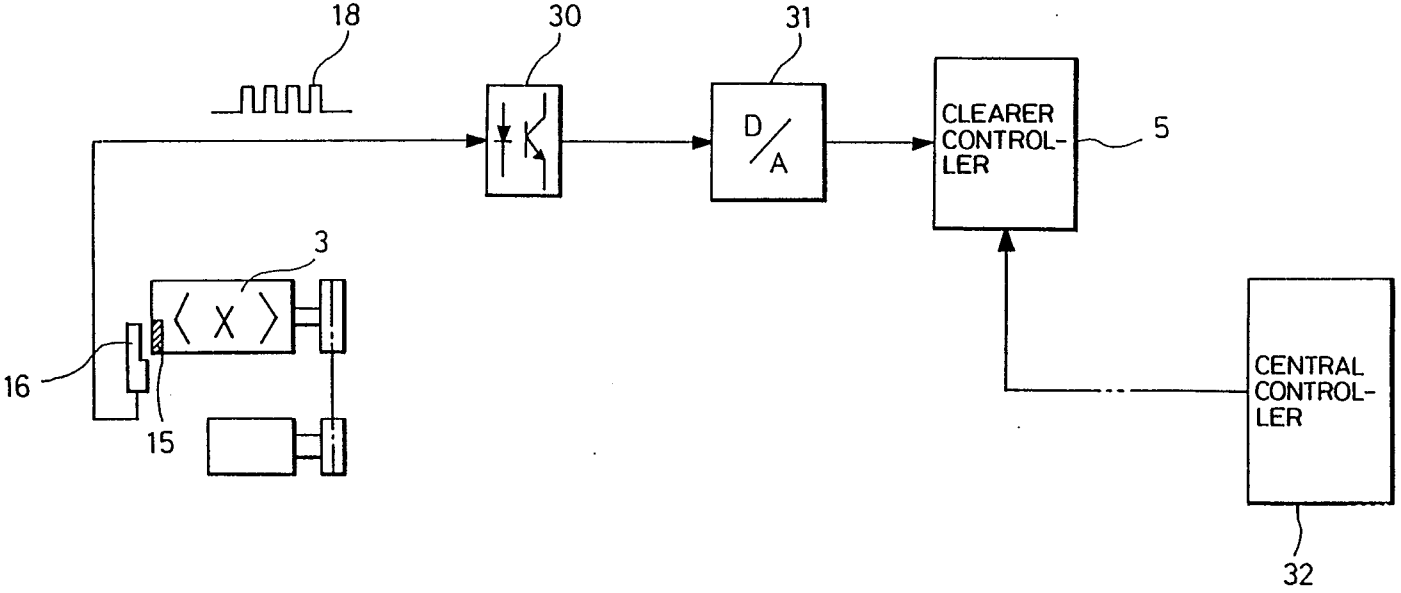
FIG. 1 is a block diagram showing an embodiment of a device for reducing a method of the present invention to practice.

Referring now to FIG. 1, a pulse signal 18 produced upon rotation of the drum 3 is delivered to an isolator 30 by means of which noises are removed from the pulse signal 18 and then to a digital to analog converter 31 by means of which it is converted into an analog voltage which corresponds to the yarn speed. The analog voltage is then applied to the clearer controller 5.

In the clearer controller 5, a reference value V12, which is set by way of a central controller 32 provided for setting a reference length for all winding units of the automatic winder, is corrected with the analog voltage to form a reference value V.

Figure 4:
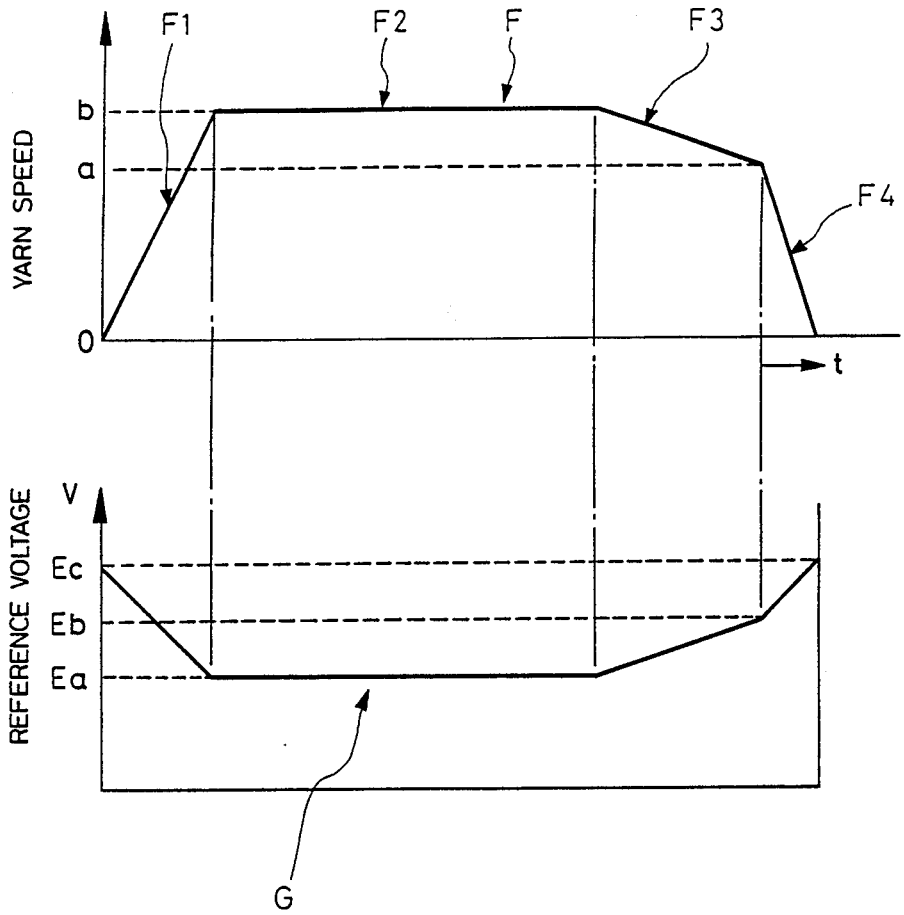
FIG. 4 is a diagram illustrating a relationship between a speed of a yarn and a reference voltage.

Referring to FIG. 4, for example, at portions F1, F3, and F4 of a diagram F corresponding to the periods at which the yarn speed varies with respect to the winding time t, the reference voltage for the reference length varies as a proportional function of the yarn speed as seen from another diagram G. Here, the portion F1 of the diagram F, which exhibits a change in yarn speed, corresponds to a rising time of the traverse drum which occurs when the rewinding of a yarn from a spinning bobbin is started. The varying portion F3 exhibits a change or reduction of the yarn speed when the speed for winding a yarn onto a package is lowered a little due to an increase in resistance against releasing of the yarn which occurs as a layer of the yarn gradually decreases in thickness during rewinding of the yarn from a bobbin. Meanwhile, the yarn speed varying portion F4 of the diagram F exhibits a change or reduction of the yarn speed which occurs while the traverse drum continues its rotation, by its own inertia, to continue winding of a yarn after the drum motor has been stopped.

It is to be noted that the speed varying portions F3 and F4 are shown only for illustration, and actually the portions F3 and F4 may not appear in a contiguous relationship. Rather the yarn speed is reduced to zero just after the varying portion F3 because the yarn has been wound up and there is no yarn to be further unwound from the bobbin. Accordingly, if a fully wound up signal is developed during winding of a yarn at a normal winding speed, the varying portion F4 appears just after a fixed speed portion F2 of the diagram F, that is, the movement of the drum by its own inertia appears just after the fixed speed portion F2.

Anyway, as the yarn speed varies, the reference value for comparison is changed so that while an absolute value of the actual length L1 of a yarn defect which may appear at various feeding speeds does not vary, the relative length of such a yarn defect relative to a yarn speed may be constant.

It is to be noted that, upon the occurrence of a yarn defect B as shown in FIG. 3 which is D2 in thickness and L2 in length, the reference voltage V22 for the length L2 is naturally corrected in a similar manner with an analog voltage corresponding to the feeding speed of the yarn as the yarn speed varies.

Figure 5:
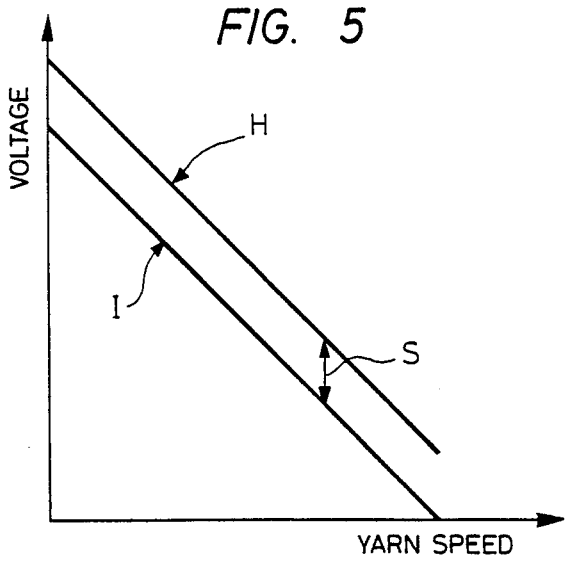
FIG. 5 is a diagram illustrating a relationship between a detected value and a reference value.

More in particular, if case the detected voltage value from a defect of the length L1 varies as indicated by a diagram H in FIG. 5 as the yarn speed increases, the set reference value to be supplied from the central controller 32 to each winding unit is also corrected to such a value as indicated by another diagram I in FIG. 5 in order that the difference S between the detected value H and the reference value I at the varying yarn speed may be controlled to remain constant.

It is to be noted that while FIG. 5 illustrates a case wherein the detected voltage value decreases as the yarn speed increases, other embodiments may operate whereby an electric signal is processed such that the voltage value may increase as the yarn speed increases and the reference value is corrected such that it may also increase in a similar manner.

As apparent from the foregoing description, according to the present invention, a set reference value which is to be compared with a detected value of a length of a defect of a yarn is automatically corrected in accordance with a change of the speed of the yarn in order to detent such a yarn defect. Accordingly, upon starting of winding, or during continued rotation of a traverse drum by its own inertia after development of a fully wound up signal, or otherwise upon appearance of a change in speed of the yarn at any other stage during winding, a detected value can normally be compared with a reference value which is corrected in accordance with the current yarn speed, and accordingly a length of a yarn defect can be detected with accuracy so as to eliminate unnecessary cutting of a yarn. Further, since the necessity of blocking of a function of a yarn clearer during rotation of a traverse drum by its own inertia can be eliminated, a defect of a yarn can be detected at any point of time during feeding of the yarn from the start to the end of winding. Accordingly, a package of a high quality yarn can be obtained.

What is claimed is:

1. A method of detecting a defect of a yarn, characterized in that it comprises the steps of producing an electric signal in accordance with a feeding speed of a yarn, providing a reference value corresponding to a predetermined defect length of a yarn, correcting the reference value in accordance with the electric signal, and comparing the thus corrected reference value with a detection signal produced from a yarn detector thereby to detect a defect of the yarn greater than the predetermined defect length included in the yarn during feeding.

2. A method of detecting a defect of a yarn as claimed in claim 1, wherein:

said step of comparing the thus corrected reference value with a detection signal comprises the step of producing a detection signal having a voltage value dependent upon the length of the detected defect, wherein said voltage value varies with varying yarn feeding speeds; and said step of correcting the reference value comprises the step of changing the reference value in response to the varying yarn feeding speed such that the difference between the corrected reference value and the voltage value of the detection signal remains constant over varying feeding speeds.

3. A method as claimed in claim 2, further comprising the step of:

cutting the yarn being wound in response to the second signal exceeding the reference value.

4. A method of detecting a defect of a running yarn wherein the defect of a yarn is detected on a thickness and length of the defected yarn portion, an electric signal corresponding to the thickness or length of the yarn defect portion, which has a defect in thickness, is delivered to and compared on a comparator with a predetermined threshold value, and a cutter driving circuit is activated according to the electric signal, the method characterized in that it comprises the step of changing said reference value corresponding to a length of a defected yarn portion to provide the predetermined threshold value in correspondence with a measured change of the speed of a yarn so that the relative length of the yarn defect portion relative to a feeding speed of the yarn is maintained constant.

5. A method of detecting a defect of a running yarn as claimed in claim 4, wherein said step of changing the reference value comprises the steps of producing a pulse signal upon rotation of a drum on which a yarn is wound, delivering the pulse signal to a digital to analog converter, converting the pulse signal into an analog voltage which corresponds to the yarn speed by means of the digital to analog converter, and applying the analog voltage to a clearer controller.

6. A method of detecting a defect of a running yarn as claimed in claim 5, wherein a plurality of winding units of a winder are controlled, said method further comprising the steps of setting a reference value by a central controller which is provided for setting a predetermined threshold value for all winding units of the winder and correcting the reference value with the analog voltage to form the predetermined threshold value in said clearer controller.

7. A method of detecting a defect in a yarn being wound at a varying winding speed, said method comprising the steps of:

detecting the winding speed of the yarn being wound;

producing a first signal corresponding to the detected winding speed;

providing a predetermined yarn defect length threshold value;

determining a reference value by correcting the predetermined threshold value in dependence upon the first signal;

detecting a defect in the yarn being wound;

producing a second signal corresponding to the time duration of the detection of the defect in the yarn; and comparing the second signal with the reference value.

8. A method of detecting a defect in a yarn being wound at a varying speed, said method comprising the steps of:

detecting the thickness of the yarn being wound;

producing a first signal having a value corresponding to the detected yarn thickness;

comparing the value of the first signal with a first reference value;

producing a second signal upon the first signal exceeding said first reference value, the second signal having a duration corresponding to the duration with which the first signal exceeds the first reference value;

producing a third signal, the third signal having a corresponding to the duration of the second signal;

detecting the winding speed of the yarn;

producing a second reference value which is adjusted corresponding to the detected winding speed; and comparing the value of the third signal with the second reference value.

9. A method as claimed in claim 8, further comprising the step of:

cutting the yarn being wound in response to the value of the third signal exceeding the second reference value.

* * * * *